US005423202A

United States Patent [19]

Komatsu et al.

[11] Patent Number: 5,423,202

[45] Date of Patent: Jun. 13, 1995

[54] TRANSFER PRESS

[75] Inventors: Isamu Komatsu; Shozo Imanishi; Takashi Yagi, all of Sagamihara, Japan

[73] Assignee: Aida Engineering, Ltd., Kanagawa, Japan

[21] Appl. No.: 105,951

[22] Filed: Aug. 13, 1993

[30] Foreign Application Priority Data

Aug. 24, 1992 [JP] Japan ..... 4-224073

[51] Int. Cl.[6] ..... B21D 43/05

[52] U.S. Cl. ..... 72/405; 483/14

[58] Field of Search ..... 72/405, 448; 198/621; 483/14, 15

[56] References Cited

U.S. PATENT DOCUMENTS 4,557,133 12/1985 Mikusch ..... 72/405
4,621,516 11/1986 Schafer ..... 72/405

FOREIGN PATENT DOCUMENTS 192834 7/1990 Japan ..... 72/405
1321846 7/1973 United Kingdom ..... 72/405

*Primary Examiner*—Daniel C. Crane
*Attorney, Agent, or Firm*—Steven M. Rabin

[57] ABSTRACT

A transfer press provided with a three-dimensional transfer system and a moving bolster. In the press, there are provided one each of four corners of the bolster an advancing/returning unit for performing an advancing-/returning operation on a workpiece, a clamping/unclamping unit for performing a clamping/unclamping operation on the workpiece and a lifting/lowering unit for performing a lifting/lowering operation on the workpiece. The units include motors that make it possible for the bolster to carry a pair of feed bars thereon and permit the units to perform their operations even when the bolster is outside the press.

6 Claims, 8 Drawing Sheets

TRANSFER PRESS

BACKGROUND OF THE INVENTION

1. Field of the Invention

The present invention relates to a transfer press in which a workpiece is transferred between successive work stations in a multi-station process performed in the press.

2. Description of the Prior Art

In a conventional transfer press, there is provided a two-dimensional transfer system for driving a pair of feed bars so as to have the feed bars perform an advancing/returning and a clamping/unclamping operation on a workpiece, so that the workpiece is sequentially transferred to a plurality of dies disposed in successive work stations on a bolster. In case of a three-dimensional transfer system for driving the feed bars of the press, in addition to the advancing/returning and the clamping/unclamping operation of the workpiece, the feed bar is further driven vertically to perform a lifting/lowering operation on the workpiece. For facilitating an exchange of the dies in the press, the bolster may be taken out of the press while carrying the dies thereon. The bolster of this type is a so-called "moving bolster".

A three-dimensional transfer system 10 and a so-called moving bolster 3, of the conventional transfer press are shown in construction in FIGS. 7 and 8.

In FIG. 7, the moving bolster 3 is provided with a plurality of work stations denoted by the reference characters: Nos. 1 to 6. The moving bolster 3 may be taken out of the press in directions Y1 and/or Y2, while traveling in these directions by means of tires/rails (not shown). As is clear from FIG. 7, the size of the press in plan view is determined by a space between each pair of columns 1 the number of which is four.

As shown in FIG. 7, a clamping/unclamping unit 30 forming a part of the three-dimensional transfer system 10 moves four cradles 12 (which carry the pair of the feed bars 11 thereon) back and forth in a direction Y to have the feed bars 11 perform the clamping/unclamping operation of the workpiece. On the other hand, a lifting/lowering unit 40 of the transfer system 10 is so formed as to be integral with the clamping/unclamping unit 30, and moves the cradles 12 back and forth in a direction Z (shown in FIG. 8) to have the feed bars 11 perform the lifting/lowering operation of the workpiece. Further, an advancing/returning unit 20 of the transfer system 10 is provided in an area adjacent to end portions of the feed bars 11, and connected with pins lip (shown in a left-hand end area of FIG. 7). The pins 11P ape provided in the above end portions of the feed bars 11, and moves the feed bars 11 back and forth in a direction X to have the feed bars 11 perform the advancing-/returning operation on the workpiece.

These operations on the workpiece performed by the feed bars 11 follow a transfer mode shown in FIGS. 6(A) and 6(B). Since the feed bars 11 ape mounted on the cradles 12 so as to be slidably movable in the direction X relative to the cradles 12, it is possible fop the feed bars 11 to perform each of the above operations independently or simultaneously during a part of the mode.

In the above construction of the transfer system 10 comprising the units 20, 30 and 40, the feed bars 11 are provided with fingers, and perform the above operations through suitably selected ones of various drive mechanisms, for example such as a rack/pinion drive mechanism, a crank-arm drive mechanism, a drive-lever mechanism, a planetary-gear drive mechanism and the like by using torque transmitted through cams, levers and rods fixedly mounted on a crank shaft or a slider of the press. Consequently, as shown in FIGS. 7 and 8, each of the units 20, 30 and 40 is fixedly mounted in a space between the columns 1.

Incidentally, in case the transfer system 10 is driven by servo-motors in a conventional manner, the same drive mechanisms as those described above may be used. In FIG. 7, the reference numeral 9 denotes an unloader of outlet conveyer of the workpiece. In FIG. 8, the reference numeral 2 denotes a bed of the press.

In an operation of exchanging the dies on the moving bolster 3 in the conventional press, it is also necessary for the press to simultaneously perform an exchanging of fingers (which are fixedly mounted on the feed bars 11) so as to have the current fingers replaced with fingers corresponding to a new workpiece. Namely, in order to replace the current fingers with the fingers corresponding to the new workpiece, the feed bars 11 are supported by holding members 3P (shown in two-dotted chain lines in FIG. 8) and taken out of the press by the same members 3P. At this time, since opposite ends of each of the feed bars 11 are connected with the transfer system 10 (i.e., with the units 20 and/or 30, 40), it is impossible for the conventional press to take the entire feed bars 11 out of the press together with the bolster 3.

In order to solve the above problem, in another conventional transfer press, there has been proposed a pair of split-type feed bars each of which is divided into three members: a movable feed bar 11 being on the side of the moving bolster 3; and, a pair of stationary feed bars 11R fixedly mounted on the transfer system 10 (i.e., on the units 20, 30 and 40). The movable feed bar 11 is connected with each of the stationary feed bars 11R through a splitting mechanism 11S so as to be integral with the stationary feed bars 11R during the multi-station process performed in the press, and separated from the stationary feed bars 11R when the movable feed bars 11 are taken out of the press together with the moving bolster 3.

The entire length of each of the feed bars (11, 11S, 11R) constructed of the movable ones 11, splitting mechanisms 11S and the stationary feed bars 11R is determined by the number of the work stations of the press and a feed stroke in the advancing/returning operation of the workpiece. Consequently, the entire longitudinal length of the press or a space between the columns 1 in the direction X of the press is determined by the above entire length of the feed bar (11, 11S, 11R).

Therefore, the conventional transfer press provided with the moving bolster 3 and the three-dimensional transfer system 10 comprising the units 20, 30 and 40 suffers from the following problems (1) to (6):

(1) When the number of the work stations and the feed stroke of the workpiece are determined, a space between the columns 1 is automatically determined. Consequently, it is impossible for the conventional transfer press to reduce the thus determined space between the columns 1, which makes it impossible to downsize the transfer press itself.

(2) In case that the feed bars 11 are carried by the holding members 3P on the side of the moving bolster 3 when the feed bars 11 are taken out of the transfer press, there is a possibility that the feed bars 11 may fall down on the side that the fingers are mounted portion due to the weight of the fingers.

Incidentally, in order to solve the above falling-down problem, there have been proposed various types of the conventional holding members 3P, for example such as ones provided with: fastening magnets; fastening screws; fastening springs; and like fastening means; in addition to ones using the weight oft the feed bars 11 to have the bars 11 engaged with the holding members 3P under the influence of gravity (hereinafter referred to as the gravity type: see Japanese Utility Model Publication No. Sho 62-457766). However, any one of the conventional holding members 3P suffers from its inherent problem. Namely, in the holding members 3P of the fastening-magnet type, there is a fear that the holding members 3P attract iron objects. In addition, the holding members 3P oft this type has a tendency to deteriorate in their holding power with the lapse of time. On the other hand, in the holding members 3P of the fastening-screw type, this type takes too much time in operation. In addition, it is hard to automatically operate this fastening-screw type of the holding members 3P. In case of the holding members 3P of the gravity type, since the holding power of such members 3P largely depends on the weight of the feed bars 11, it is impossible to downsize the feed bars 11.

(3) Even after the feed bars 11 are taken out of the transfer press together with the moving bolster 3, it is necessary for the operator of the press to manually move the heavy feed bars 11 before both of an exchange of the dies and an exchange of the fingers are conducted. However, such manual work for moving the feed bars 11 is very hard and risky. Particularly, it is difficult to reduce the working time required in the manual work, which makes it impossible to satisfy the current need for further improving the transfer press in efficiency.

(4) Since it is impossible to conduct dynamic adjustments of the feed bars 11 including the finger's alignment operation in a condition in which the moving bolster 3 is taken out of the press, it takes too much time to ensure the press in reproducibility of the process after completion of the die exchange.

(5) The conventional transfer press is poor in versatility since the press is integral with the transfer system 10 comprising the units 20, 30 and 40.

(6) When any one of the constituent elements of the clamping/unclamping unit 30 (for example) of the conventional transfer press fails, it is necessary to stop the whole of the press in operation.

SUMMARY OF THE INVENTION

It is an object of the present invention to provide a transfer press excellent in versatility and productivity, the press making it possible to promptly exchange the dies in an easy manner and also making it possible to ensure the reproducibility in the process performed in the press.

In view of the above problems inherent in the conventional transfer press caused by the conventional transfer system and the conventional moving bolster each of which is independently constructed to accomplish its own purpose, the above object of the present invention is accomplished by providing a transfer press which has a transfer system operably integral with a moving bolster.

Namely, according to a first aspect of the present invention, the above object of the present invention is accomplished by providing:

In a transfer press in which a pair of feed bars are driven by a transfer system so as to perform an advancing/returning, a clamping/unclamping and a lifting/lowering operation of a workpiece so that the workpiece is sequentially transferred between a plurality of dies disposed in successive work stations provided on a moving bolster which is taken out of the transfer press while carrying the dies thereon, the improvement wherein:

each of the feed bars is constructed of a movable feed bar element and a stationary feed bar element; and the transfer system comprises: a plurality of second casings the number of which is four, each of the second casings being fixedly mounted on each of four corner portions of the bolster; a plurality of first casing the number of which is four, each of the first casings being mounted on a respective one of the second casings so as to be vertically movable relative thereto; a lifting/lowering unit for each pair of first and second at a respective corner portion of the bolster, each lifting/lowering unit; provided with a first motor and a first threaded shaft operably connected with the first motor for driving of the first casing so as to have the same lifted and lowered relative to each of the second casings, the first motor being fixedly mounted on each of the second casings; a clamping/unclamping unit provided with a second motor and a second threaded shaft operably connected with the second motor for driving the stationary feed bar element so as to perform the same clamping/unclamping operation on the workpiece, the second motor being fixedly mounted on each of the first casings; and, an advancing/returning unit provided with a third motor and a third threaded shaft operably connected with the third motor for driving the movable feed bar element so as to have the same perform the advancing/returning operation of the workpiece, the movable feed bar element being moved relative to the stationary feed bar element in the advancing/returning operation, the third motor being fixedly mounted on each of the first casings which are aligned in a longitudinal direction of the transfer system.

Further, according to a second aspect of the present invention, the above object of the present invention is accomplished by providing:

The transfer press as set forth in the first aspect of the present invention, wherein:

each of the feed bars is not of a split type constructed of a plurality of feed bar elements aligned with each other in series in a longitudinal direction of the transfer system, but of an integrated type in which the movable feed bar element and the stationary feed bar element are arranged in parallel with each other so as to minimize the entire longitudinal length of each of the feed bars.

Since the transfer press of the present invention has the above construction, when the transfer system stops in operation or remains stationary, the feed bars are carried by the transfer system constructed of the motor-driven units comprising the advancing/returning unit, the clamping/unclamping unit and the lifting/lowering unit disposed in the four corner portions of the moving bolster. Further, in the present invention, each of the feed bars is not of the split type but of the integrated type to minimize the entire longitudinal length thereof, which permits the moving bolster to be readily taken out of the press. In addition, since the present invention enables the feed bars to perform each of the clamping-/unclamping, the lifting/lowing and the advancing-/returning operation even in a condition in which the feed bars are taken out of the press, it is not required for the operator to manually move the feed bars, which makes it possible to readily perform an exchange of the dies and also makes it possible to perform dynamic adjustments of the feed bars including alignments of the fingers in a prompt and a precise manner. After completion of such dynamic adjustments, the moving bolster is then moved into the press so as to make it possible to immediately start the press working.

Further, in case at least two moving bolsters each of which is provided with the transfer system are provided in the transfer press of the present invention, it is possible for the press of the present invention to minimize its downtime when one of the transfer systems fails, which remarkably improves the press in productivity.

Since the transfer press of the present invention has the above construction, it is possible to downsize the press, save its manufacturing cost and minimize the longitudinal length of each of the feed bars, which makes it possible to downsize the whole of the transfer press of the present invention.

DESCRIPTION OF THE PREFERRED EMBODIMENTS

Hereinbelow, preferred embodiments of the present invention will be described in detail with reference to the drawings.

Figure 1:
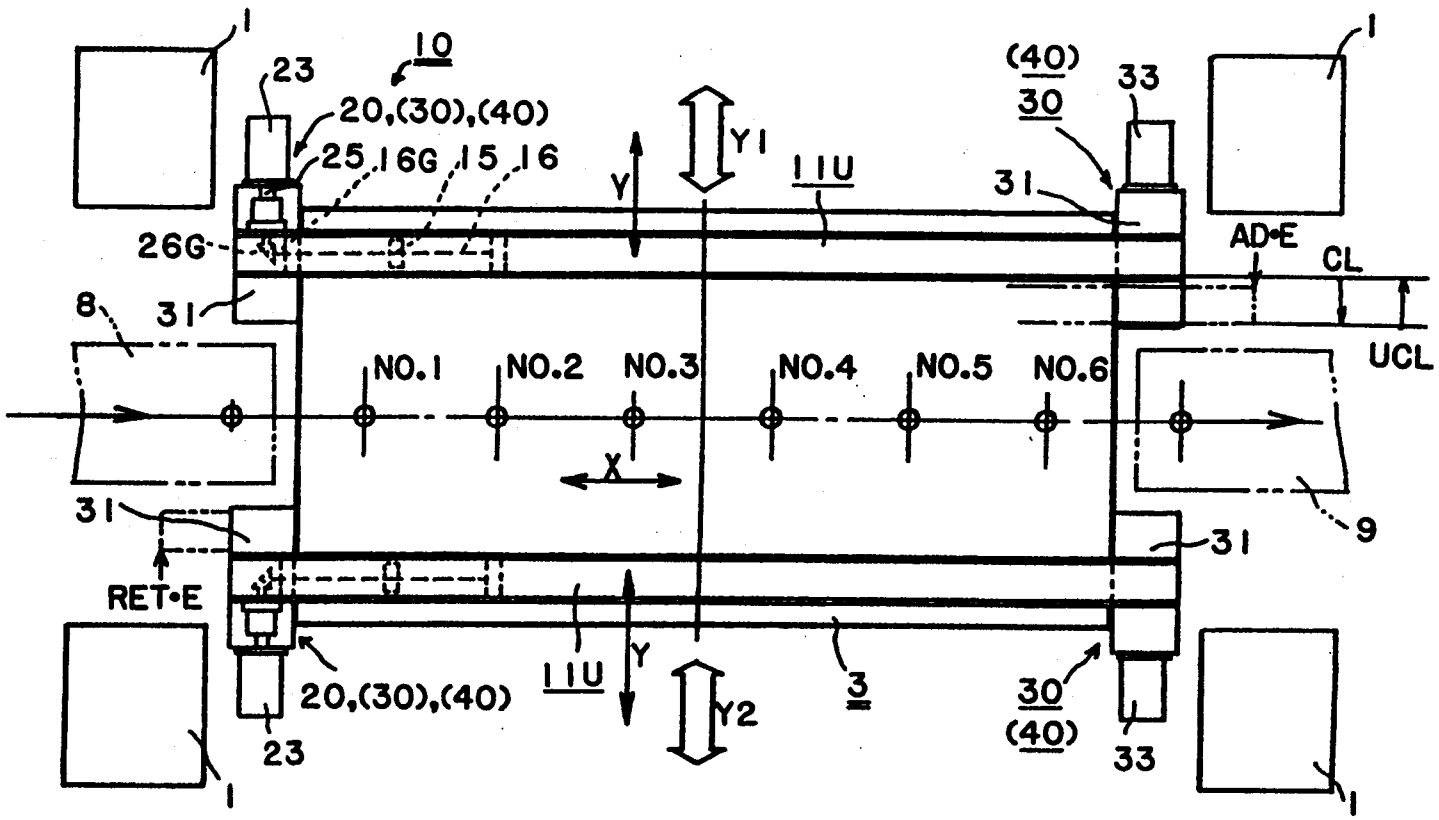
FIG. 1 is a plan view of a first embodiment of the transfer press of the present invention.
Figure 2:
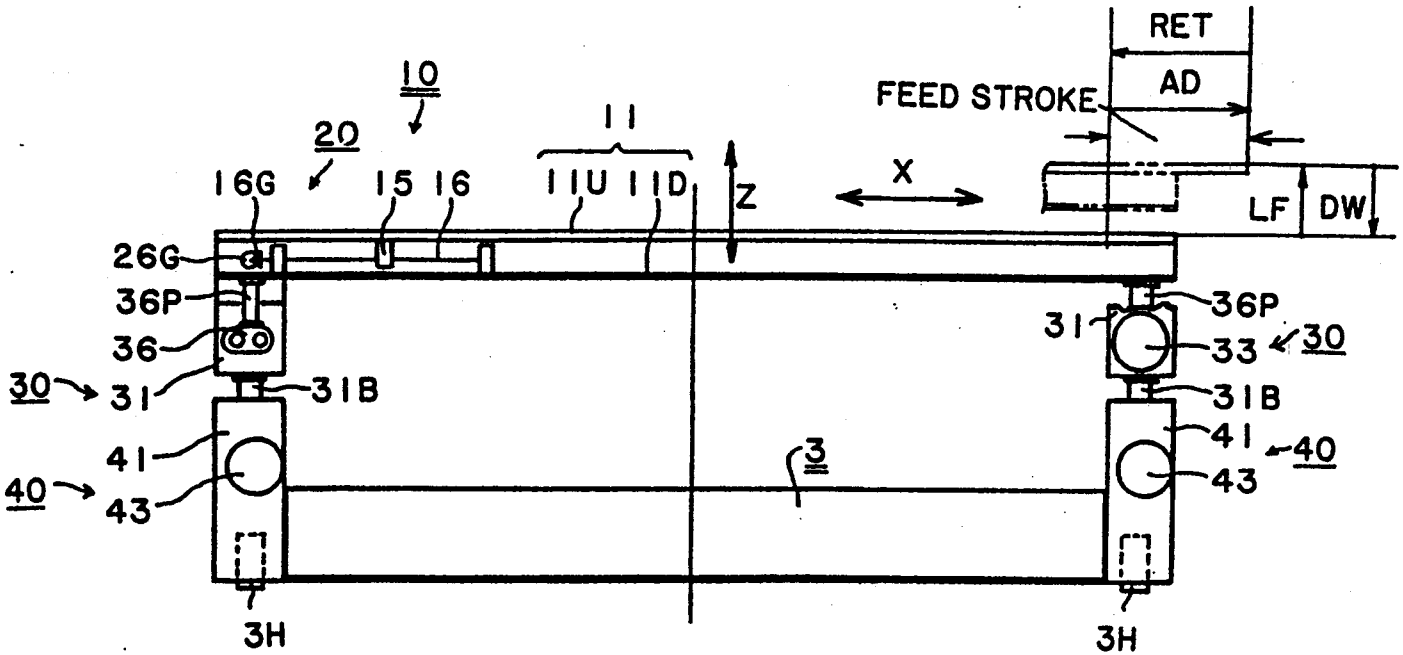
FIG. 2 is a a side view of the transfer press of the present invention shown in FIG. 1.
Figure 3:
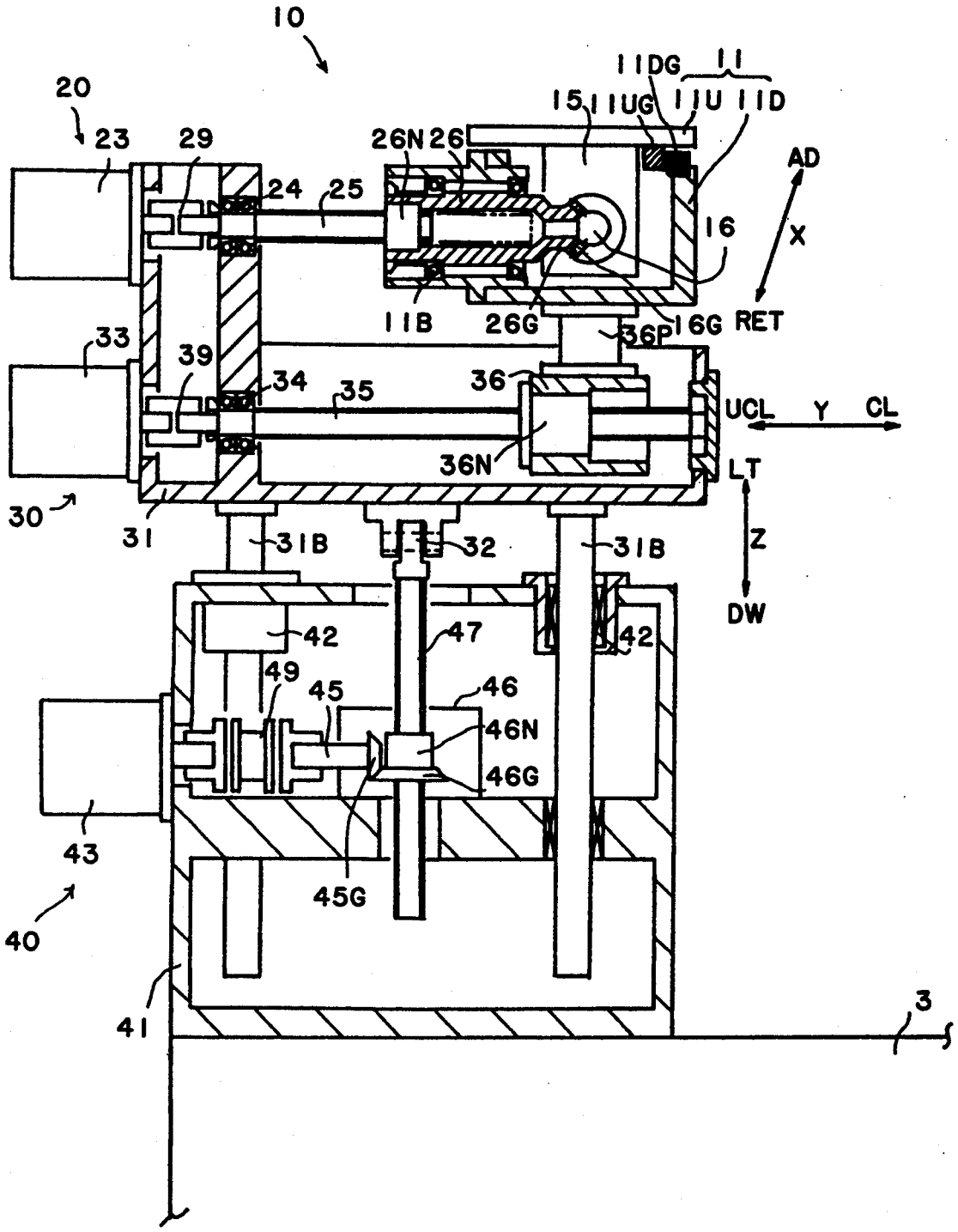
FIG. 3 is a longitudinal sectional view of the transfer press shown in FIG. 1.

As shown in FIGS. 1 to 3, a first embodiment of a transfer press of the present invention is provided with a three-dimensional transfer system 10 and a moving bolster 3. Since the transfer system 10 (20, 30, 40) is mounted on the moving bolster 3, the moving bolster 3 carrying a pair of feed bars 11 thereon permits the transfer system 10 to perform its functions even when the moving bolster 3 is outside the press.

Figure 7:
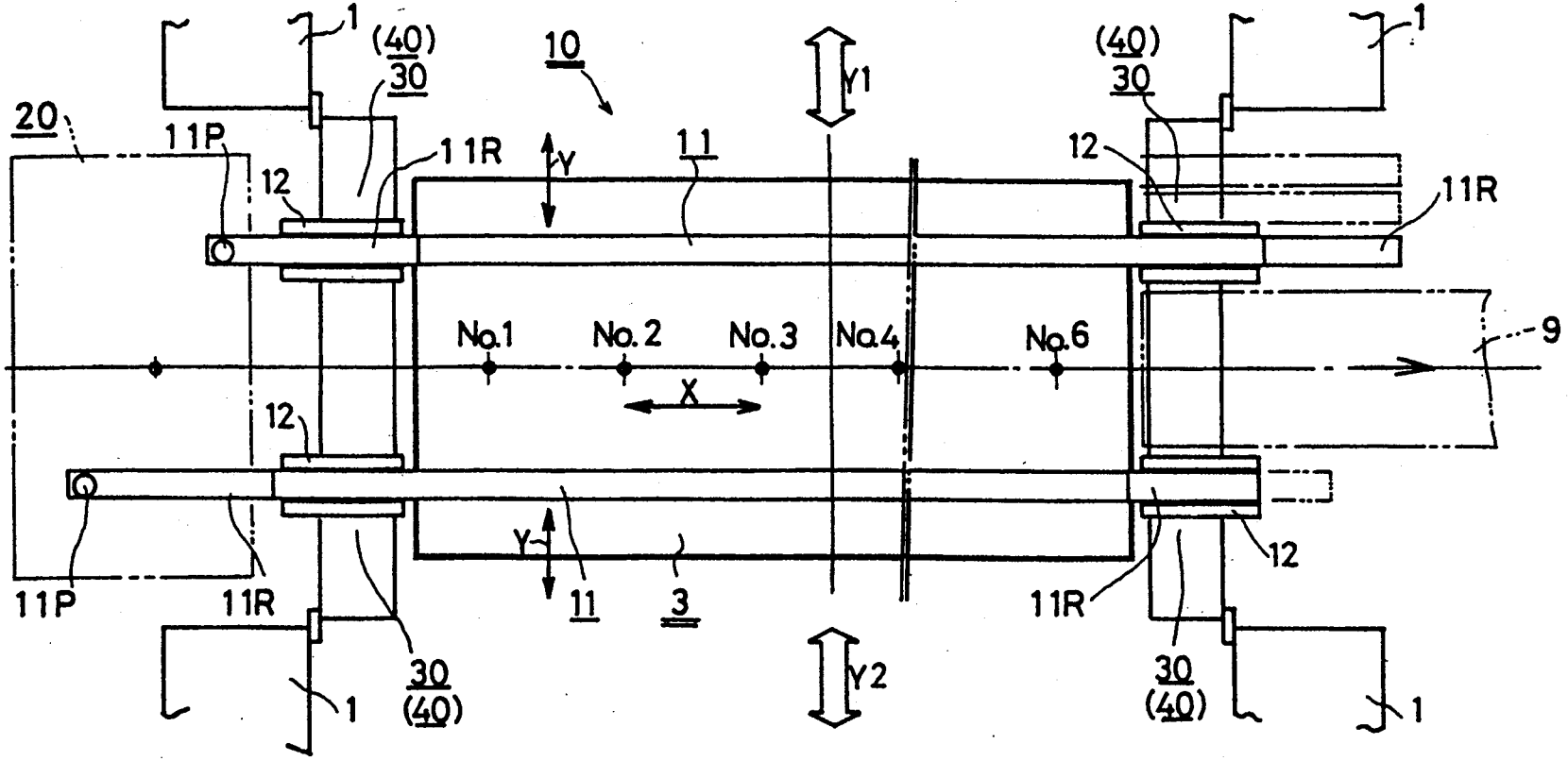
Fig. 7 (Prior Art)
FIG. 7 is a plan view of the conventional transfer press.
Figure 8:
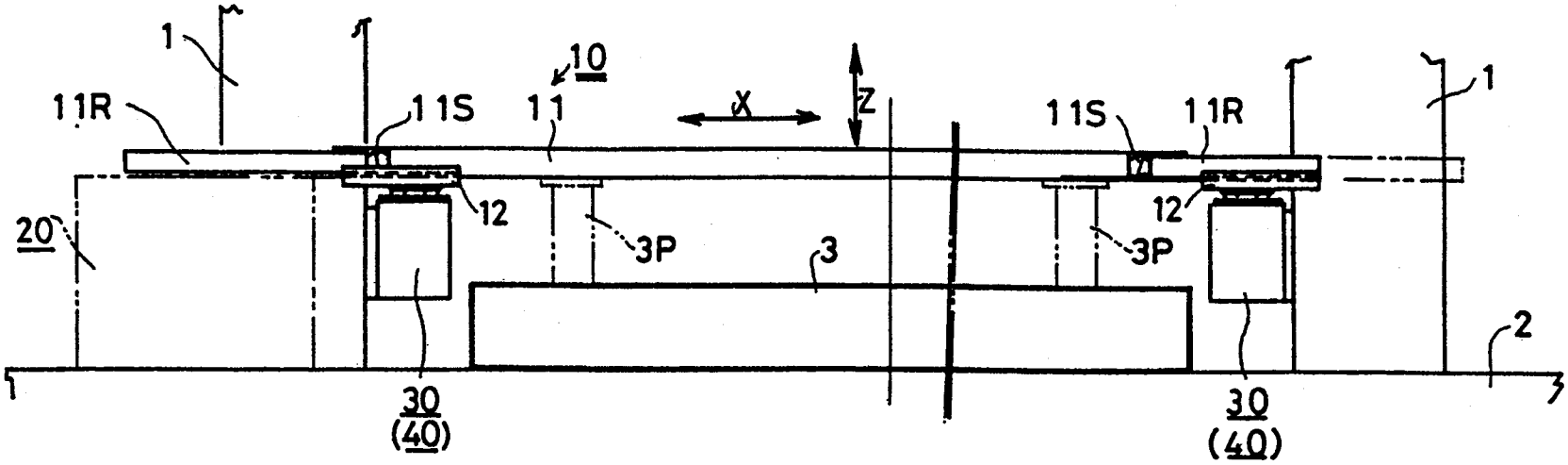
Fig. 8 (Prior Art)
FIG. 8 is a slide view of the conventional transfer press shown in FIG. 7.

Incidentally, like reference numerals apply to similar parts throughout the drawings including FIGS. 7 and 8, to avoid redundancy in description.

FIGS. 1 and 2 show a condition in which the moving bolster 3 is mounted in a predetermined position inside the transfer press comprising four columns 1. The moving bolster 3 is provided with tires 3H (shown in dotted lines in FIG. 2), and, therefore may travel in a direction Y1 or Y2 (shown in FIG. 1). An inlet conveyer 8 for carrying in the workpiece is shown in two-dotted chain lines in the left-hand end of the press as viewed in FIG. 1. On the other hand, an outlet conveyer 9 is shown in two-dotted chain lines in the right-hand end of the press as viewed in FIG. 1. Incidentally, as is clear from FIG. 1, the moving bolster 3 in a position after having been taken out of the press for performing an exchange of the dies, is not shown in the drawings.

The transfer system 10 of the present invention is of a three-dimensional type constructed of: advancing-/returning units 20 for moving each of the feed bars 11 back and forth in a direction X (shown in FIG. 2) by an amount of a feed stroke corresponding to the spacing of the work stations No. 1 to No. 6 shown in FIG. 1, so as to perform an advancing operation AD and a returning operation RET on the workpiece; clamping/unclamping units 30 for moving the feed bars 11 in a direction Y so as to perform a clamping operation CL and an unclamping operation UCL on the workpiece; and, lifting/lowering units 40 for moving the feed bars 11 in a direction Z (shown in FIG. 2) so as to perform a lifting operation LF and a lowering operation DW on the workpiece.

As shown in FIGS. 2 and 3, each of the feed bars 11 is constructed of a downside stationary feed bar element 11D and an upside movable feed bar element 11U to which a plurality of fingers are mounted. These elements 11D, 11U are slidably engaged with each other through V-shared slide guides 11UG, 11DG so as to be movable in the direction X relative to each other. As shown in FIG. 1, the upside feed bar element 11U reaches a position of an advance end AD.E in the advancing operation AD, and reaches a position of a return end RET.E in the returning operation RET. Both the advance end AD.E and the return end RET.E are shown in two-dotted chain lines in FIG. 1.

Namely, in operation, since the transfer system 10 (20, 30, 40) is mounted on the moving bolster 3, it is possible to drastically downsize the feed bars 11 in length, whereby the thus downsized feed bars 11 of the present invention may realize the same feed stroke as that realized by the conventional large-sized feed bars. Such downsized feed bars 11 of the present invention may be therefore lessened in rigidity and in weight, and improved in precision on feeding operation of the workpiece. Further, the thus downsized feed bars 11 enable the moving bolster 3 to be easily taken out of the press.

As shown in FIG. 3, the clamping/unclamping units 30 each constructed of: a second threaded shaft or ball-screw shaft 35 which is rotatably mounted in a respective first casing 31 through a bearing 34; a slider 36 in which a ball-nut member 36N threadably engaged with the ball-screw shaft 35 is fixedly mounted; and, a second motor or servo-motor 33 connected with the ball-screw shaft 35 through a coupling 39. On the slider 36, the upside stationary feed bar element 11D is fixedly mounted through a holder 36P.

Consequently, the clamping/unclamping unit 30 may carry the feed bars 11 (11U, 11D) thereon. Therefore, as is clear from FIGS. 1 and 3, it is possible to move the feed bars 11 back and forth in the direction Y by actuating the second servo-motor 33, whereby the clamping operation CL and the unclamping operation UCL of the workpiece are performed.

On the other hand, as shown in FIG. 3 advancing-/returning unit 20 (aligned in the Y direction on the left-side first-casings 31) comprises: a ball-spline shaft 25 rotatably mounted in the first casing through a bearing 24; a ball-spline nut member 26N slidably engaged with the ball-spline shaft 25; a rotary element 26 fixedly mounted on the ball-spline nut member 26N; a third servo-motor 23 which is connected with the ball-spline shaft 25 through a coupling 29 and fixedly mounted on a respective one of the first casings 31. Consequently in operation, when the third servo-motor 23 is actuated, the upside movable feed bar element 11U is moved back and forth in the direction X relative to the downside stationary feed bar element 11D so that the advancing operation AD and the returning operation RET on the workpiece are performed.

More particularly, the rotary element 26 is rotatably mounted in the stationary feed bar element 11D through a plurality of bearings 11B, and has its front-end portion formed into a drive-side bevel gear 26G. As shown in FIGS. 1 and 2, the bevel gear 26G is meshed with a driven-side bevel gear 16G. The gear 16G is integral with a bail-screw shaft 16 which is rotatably mounted in the stationary feed bar element 11D. The ball-screw shaft 16 is threadably engaged with a ball-nut member 15 fixedly mounted on the stationary feed bar element 11D.

Consequently, in operation, when the third servo-motor 23 is actuated, the rotary element 26 is rotatably driven so that torque is transmitted to the ball-screw shaft 16 through the bevel gears 26G, 16G, whereby the movable feed bar element 11U is moved back and forth relative to the stationary feed bar element in the direction X to perform the advancing/returning operation on the workpiece.

Incidentally, since each advancing/returning unit 20 has a construction in which the third servo-motor 23 and the rotary element 26 are connected with each other through the ball-screw shaft 25 and the ball-spline nut member 26N to permit the rotary element 26 to only linearly move in the direction Y relative to the output shaft of the servo-motor 23 so as to transmit the torque generated in the motor 23 to the rotary element 26, the units 20 permits the feed bars 11 (11D, 11U) to move back and forth in the direction Y (i.e., move right and left as viewed in FIG. 3) so as to perform the clamping unclamping operation of the workpiece.

As shown in FIG. 3, each lifting/lowering unit 40 is so constructed as to a corresponding one of the whole of the first casings 31 (in which the clamping/unclamping unit 30 is incorporated) back and forth in the direction Z (shown in FIG. 2) to have the feed bars 11 (11U, 11D) perform the lifting operation LF and the lowering operation DW of the workpiece.

More particularly, in construction, each first casing 31 is vertically movably mounted on a second casing 41 in by having its guide rods 31B inserted into stroke bearings 42 which are fixedly mounted in the second casing 41. In operation, by moving up and down a ball-screw shaft 47 which is connected with the first casing 31 through a joint member 32, it is possible to vertically move the first casing 31 so as to have the feed bars 11 (11D, 11U) perform the lifting/lowering operation of the workpiece. The ball-screw shaft 47 is threadably engaged with a ball-nut member 46N which is rotatably mounted in a gear casing 46. When the ball-nut member 46N is rotatably driven by a first servo-motor 43, the ball-screw shaft 47 is moved up and down.

More particularly, when in each casting 41 a driven-side bevel gear 46G (which is integral with the ball-nut member 46N and is meshed with a drive-side bevel gear 45G) is rotatably driven by the first servo-motor 43 through a coupling 49 and a drive shaft 45 (which is integral with the drive-side bevel gear 45G and connected with the output shaft of the servo-motor 43 through the coupling 49), the first casings 31 carrying the feed bars 11 (11D, 11U) are moved up and down together with the holders 36P thereof so that the lifting/lowering operation of the workpiece is performed. Consequently, it is possible to perform the lifting/lowering operation when the clamping/unclamping operation and/or the advancing/returning operation of the workpiece are/is performed.

Now, a drive/control console 60 for controlling the whole of the transfer press of the present invention will be described with reference to FIG. 4.

The console 60 comprises: a CPU 61; a ROM 62; a RAM 63; a control panel 64; an input port 65; and, an output port 66. Connected with the output port 66 are: the third servo-motors 23 for the advancing/returning operation on the workpiece, including a driver controller 23B; the second servo-motors 33 for the clamping-/unclamping operation, including a driver controller 33D; and, the first servo-motors 43 for the lifting/lowering operation, including a driver controller 43D. These servo-motors are controlled in rotation according to a transfer mode which is stored in the ROM 62 (or the RAM 63) and shown in FIGS. 6(A) and 6(B).

Incidentally, a control section 3DC of the press for controlling the moving bolster 3 in its exchanging operation in the press is also properly controlled. In the first embodiment of the present invention, as shown in FIGS. 6(A) and 6(B), the transfer mode is so illustrated as to be carried out by a single one of the servo-motors 23, 33, Now, the first embodiment of the present invention will be described as to its action and effect.

Figure 4:
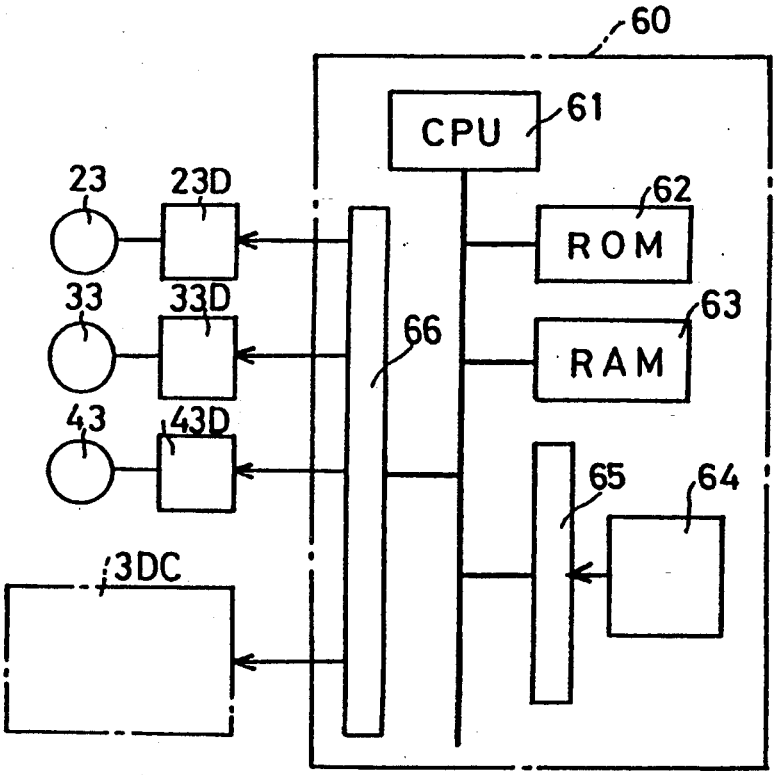
FIG. 4 is a drive/control unit for the transfer press of the present invention shown in FIG. 1.
Figure 6:
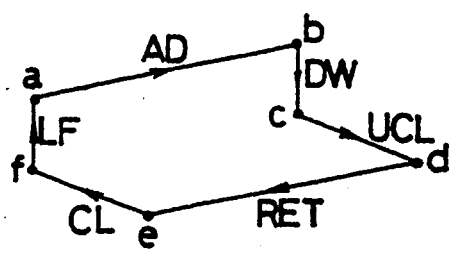
FIGS. 6(*a*) and 6(*b*) are diagrams for illustrating a transfer mode of both of the conventional transfer press and the transfer press of the present invention.
Figure 6:
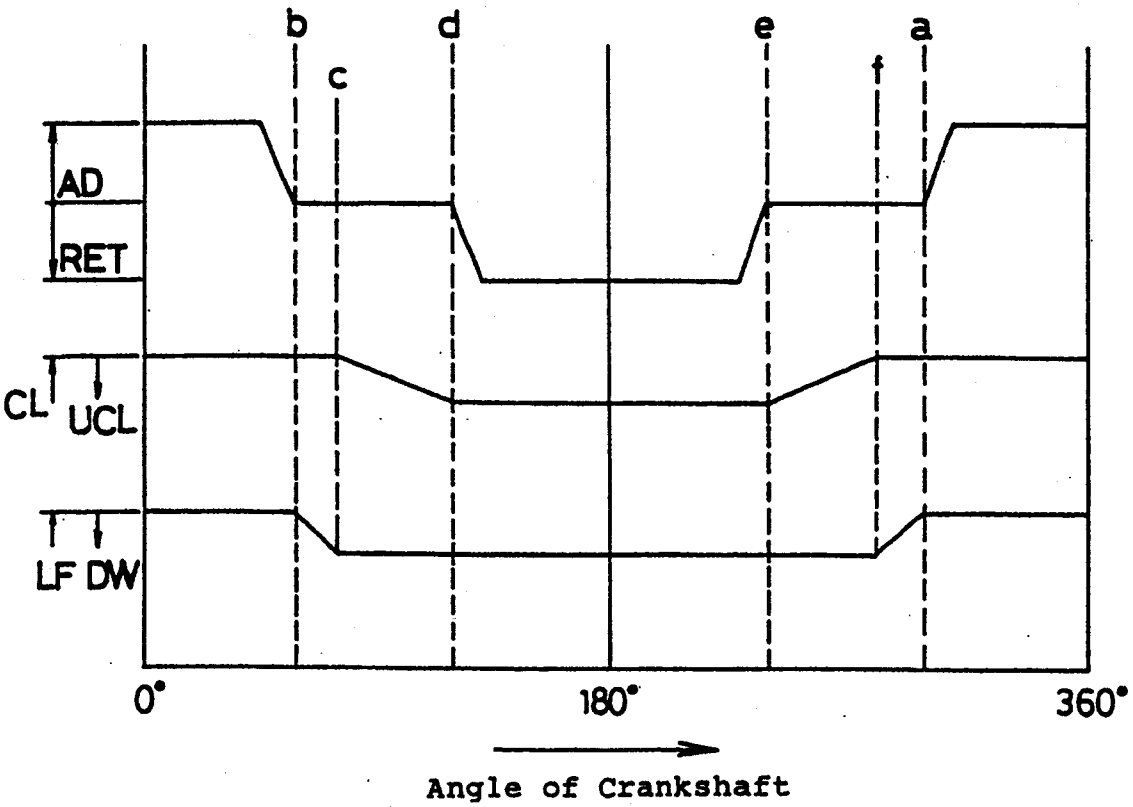

As shown in FIGS. 1 and 2, in a condition in which the moving bolster 3 is mounted in a proper or predetermined position inside the press, when a crank angle of the press reaches a position "a" in the transfer mode shown in FIGS. 6(A) and 6(B), the drive/control unit 60 (61, 62) which is shown in FIG. 4 actuates the third servo-motors 23 for driving the advancing/returning unit 20. Torque generated in each thus actuated servo-motor 23 is then transmitted to the rotary element 26 through the ball-spline shaft 25 and the ball-spline nut member 26N, and further transmitted to the ball-screw shaft 16 through the bevel gears 26G, 16G to rotatably drive the ball-screw shaft 16. As a result, the movable feed bar element 11U to which the ball-nut member 15 is fixed is moved in the direction X relative to the stationary feed bar element 11D so that the advancing operation AD of the workpiece is performed, as shown in FIGS. 1 and 2. When the movable feed bar element 11U reaches the advance end AD.E in FIG. 1, the element 11U stops in operation.

After that, when the crank angle of the press reaches a position "b" which goes beyond a position of an angle 360° and passes through a position of an angle 0° again, the drive/control console 60 controls the first servo-motors 43 of the lifting/lowering unit 40 in rotation so as to have each the servo-motors 43 rotatably drive the ball-nut member 46N through the coupling 49, drive shaft 45 and the bevel gears 45G, 46G (shown in FIG. 3), whereby the ball-screw shaft 47 is moved downward. When the shaft 47 moves downward, the whole of the first casing 31 is vertically moved downward toward the second casing 41 while guided by the guide rods 31B through the stroke bearings 42 of the second casing 41, whereby the feed bars 11 (11D, 11U) perform the lowering operation DW of the workpiece.

Then, when the crank angle of the press reaches a position "c" as viewed in FIGS. 6(A) and 6(B), each second servo-motor 33 of the clamping/unclamping unit 30 is actuated by the drive/control console 60 so that the ball-screw shaft 35 is rotatably driven by the servo-motor 33. As a result, the slider 36 which is integral with the ball-nut member 36N is moved leftward as viewed in FIG. 3 so that the feed bars 11 (11D, 11U) perform the unclamping operation UCL of the workpiece. At this time, since the ball-spline shaft 25 and the ball-spline nut member 26N are movable relative to each other in the direction Y, they permits the feed bars 11 (11D, 11U) to be guided and moved smoothly thereby in the direction Y.

When the crank angle of the press reaches a position "d", the third servo-motor 23 is reversed in rotation by the drive/control console 60. As a result, the feed bars 11 (11D, 11U) are returned to the return end RET.E (shown in FIG. 1) while lowered and kept in their unclamping state. After completion of this returning operation RET, the crank angle of the press reaches a position of an angle 180° (i.e., the bottom dead point of the press) around which the pressing work is performed.

Then, the crank angle of the press reaches a position "e" of the transfer mode shown in FIGS. 6(A) and 6(B). At the position "e", each second servo-motor 33 is reversed in rotation by the drive/control console 60 to have the feed bars 11 (11D, 11U) perform the clamping operation CL in which the workpiece is clamped with the fingers of the feed bars 11 (11D, 11U). After that, when the crank angle of the press reaches a position "f" in the transfer mode, the lifting/lowering units 40 performs the lifting operation LF. Then, the crank angle of the press returns to the position "a" of the transfer mode so that the advancing operation AD of the workpiece is performed again in a manner as described above.

As is clear from the above, since the feed bars 11 (11D, 11U) move along a three-dimensional rectilinear path shown in FIG. 6(B) according to the transfer mode shown in FIG. 6(A), it is possible for the feed bars 11 (11D, 11U) to transfer the workpiece (which has been received from the inlet conveyer 8 shown in FIG. 1) to the individual dies disposed on the successive work stations No. 1 to 6 of the moving bolster 3, and to deliver the workpiece (which has been passed through these work stations to become a product) to the outlet conveyer 9.

In the press, when an exchange of the dies is performed, the control section 3DC of the press for controlling the moving bolster 3 in its exchanging operation in the press is controlled by operating switches of the control panel 64 shown in FIG. 4. More particularly, the tires 3H shown in FIG. 2 are rotated to permit the moving bolster 3 to travel in the direction Y1 or Y2 so that the moving bolster 3 is taken out of the press and put on a site (not shown) where the exchange of the dies is performed.

The moving bolster 3 is taken out of the press while carrying the transfer unit 10 comprising the advancing-/returning units 20, clamping/unclamping units 30 and the lifting/lowering units 40. Further, the thus carried transfer unit 10 (20, 30, 40) carries the feed bars 11 (11D, 11U). Since there is substantially no difference in longitudinal length between: the feed bars 11 (11D, 11U); and the moving bolster 3, it is possible with the transfer press of the present invention, to promptly and readily take out or remove the moving bolster 3 from the press without splitting or dividing each of the feed bars, in contrast with the conventional transfer press where the splitting or dividing of each of the feed bars is required before the bolster is taken out off the press.

Incidentally, in case the transfer press off the present invention is provided with two moving bolsters 3, it is possible for the press to immediately start its pressing work after the removal of the moving bolster 3 by inserting the other moving bolster 3 (in which the exchange of the dies is already finished) into the press in the direction Y1 or Y2. As described later, in the transfer press of the present invention, since dynamic adjustments of the feed bars 11 (11D, 11U) including the alignments of the fingers (not shown) are already finished in the site where the exchange of the dies is performed, it is possible for the press to promptly ensure the reproducibility in pressing work.

In the above site where the moving bolster 3 has been taken out of the press in the direction Y1 and the exchange of the dies is performed, both the clamping/unclamping units 30 and the lifting/lowering units 40 are properly operated so that, for example, the pair of the feed bars 11 (11D, 11U) are so moved as to be separated from each other to perform the unclamping operation UCL and are moved upward to perform the lifting operation LF of the workpiece. Consequently, it is not required for the operator of the transfer press of the present invention to manually move the heavy feed bars 11 (11D, 11U) when the exchange of the dies are performed. Further, in the transfer press of the present invention, since the feed bars 11 (11D, 11U) are steadily held by the transfer system 10 (20, 30, 40), there is no danger that the feed bars 11 (11D, 11U) turn over.

Dynamic adjustments of the feed bars, including the alignments of the fingers, are performed after completion of the exchange of the dies.

In such dynamic adjustments, since any of the advancing/returning units 20, clamping/unclamping units 30 and the lifting/lowering units 40 may be operated, it is possible to promptly and properly perform such dynamic adjustments of the feed bars.

In the first embodiment of the transfer press of the present invention having been described above: the advancing/returning units 20, clamping/unclamping units 30 and the lifting/lowering units 40 are driven by the servo-motor drive mechanisms mounted on the four corner portions of the moving bolster 3; the moving bolster 3 can be taken out of the press while carrying the feed bars 11 thereon; and, even in the side outside the press, the moving bolster 3 permits the feed bars 11 to perform the advancing/returning operation and the clamping/unclamping operation of the workpiece. Consequently, it is possible to promptly remove the moving bolster 3 from the press, and also possible to perform the exchange of the dies together with the dynamic adjustments of the feed bars 11 including the alignments of the fingers. Further, it is also possible to downsize any of the transfer system 10 and the feed bars 11, which makes it possible to downsize the whole of the transfer press of the present invention.

In the transfer press of the present invention, since each of the feed bars 11 is constructed of the stationary feed bar element 11D and the movable feed bar element 11U, it is possible to remarkably reduce a load imposed on the advancing/returning units 20. In addition, since the transfer press of the present invention requires no splitting mechanism 11S of the conventional transfer press, it is possible to remarkably simplify the press in construction, which drastically saves the manufacturing cost of the press.

Further, since the transfer system 10 (20, 30, 40) of the present invention are driven by the servo-motors 23, 33, 43, it is not necessary for the transfer system to be mechanically connected with the main body of the press, which makes it possible to simplify the press in construction and makes it possible to further save the manufacturing cost of the press.

In addition, since the transfer system 10 (20, 30, 40) of the present invention are driven by the servo-motors 23, 33, 43, it is possible for the moving bolster 3 to permit any of the advancing/returning, the clamping/unclamping and the lifting/lowering operation of the feed bars 11 to be performed even outside the press in the same manner as that inside the press. This makes it possible to perform dynamic adjustments of the dies after the exchange thereof in a prompt and a practical manner. The transfer system 10 of the present invention releases the operator of the press from hard manual works, and ensures promptly the reproducibility in the pressing work.

Further, in the transfer press of the present invention, since the feed bars 11 (11D, 11U) are carried by the transfer system 10 fixedly mounted on the moving bolster 3, there is no fear that the feed bars turn over when the moving bolster 3 is taken out of the press.

In addition, since the transfer system 10 (20, 30, 40) is mounted on the moving bolster 3, and, therefore, is not integral with the press, the press is improved in versatility. In case a pair of the moving bolsters 3 are provided in the press, it is possible for the press to substantially eliminate downtime when one of the bolster 3 fails in operation.

Figure 5:
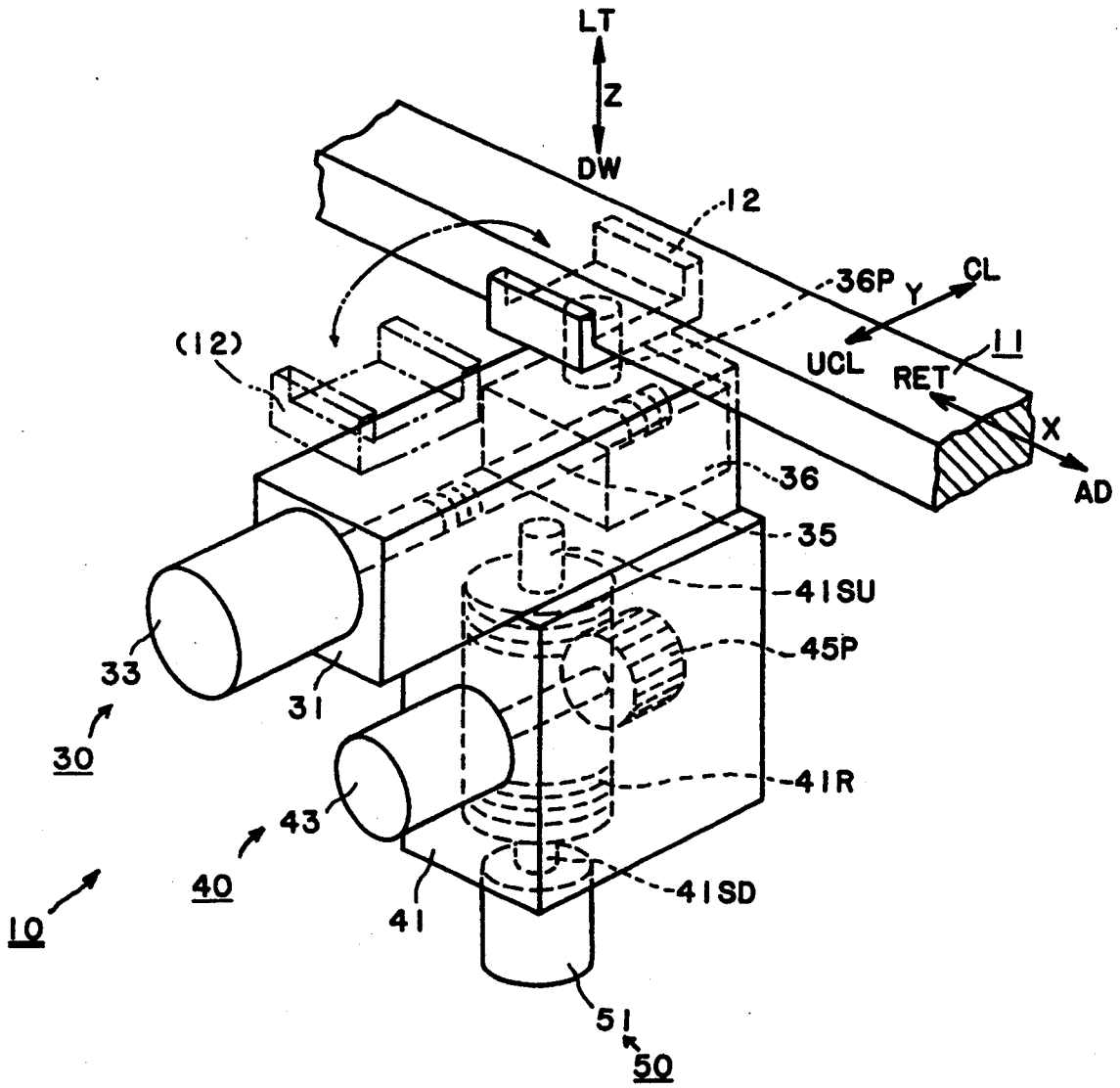
FIG. 5 is a perspective view of a second embodiment of the transfer press of the present invention.

FIG. 5 shows a second embodiment of the transfer press of the present invention.

In the second embodiment of the present invention, there are provided: the clamping/unclamping units 30; the lifting/lowering units 40; and, a rotation-avoidance unit 50, so that the exchange of the dies is enhanced. Incidentally, the advancing/returning unit 20 is omitted in FIG. 5 since the unit 20 may be combined with the remaining units 30, 40 or may be separately constructed so as to be mounted on the moving bolster 3.

As shown in FIG. 5, the clamping/unclamping unit 30 is constructed of: a ball-screw shaft 35 rotatably supported by the first casing 31; a slider 36 comprising a ball-nut member which is threadably engaged with the ball-screw shaft 35; and, a servo-motor 33. A supporting cradle 12 of each of the feed bars 11 is fixedly mounted on the slider 36. On the other hand, the lifting/lowering unit 40 is constructed of: a cylindrical rack member 41R rotatably and vertically movably mounted in the second casing 41; a pinion 45P meshed with the rack member 41B; and, a servo-motor 43 fixedly mounted on the second casing 41.

In the second embodiment of the present invention shown in FIG. 5, the second casing 41 is is fixed to the moving bolster 3. On the other hand, the first casing 31 is fixed to a shaft portion 41SU formed in an upper portion of the rack member 41R.

The rotation-avoidance unit 50 is constructed off: the cylindrical rack member 41R; and, a servo-motor 51 connected with a shaft portion 41SD formed in a lower portion of the rack member 41R. In operation, when the servo-motor 51 is actuated, the whole of the first casing 31, i.e., the supporting cradle 12 carrying each of the feed bars 11 is rotated by an angle of 180° to reach a position denoted in two-dotted chain lines shown in FIG. 5, so that the each of the feed bars 11 is moved sufficiently out of the moving bolster 3.

According to the second embodiment of the present invention shown in FIG. 5, it is possible to obtain the same action and effect as those in the first embodiment. In addition, in the second embodiment of the present invention, since the rotation-avoidance unit 50 enables the feed bars 11 to be sufficiently moved out of the moving bolster 3, the exchange of the dies is further facilitated, which makes it possible to drastically save the operation time required for the exchange of the dies.

What is claimed is:

1. In a transfer press having a pair of feed bars driven by a transfer system so as to perform advancing/returning, clamping/unclamping and lifting/lowering operations on a workpiece so that the workpiece is sequentially transferred between dies disposed in successive work stations provided on a moving bolster removable from said transfer press while carrying the dies thereon, the improvement wherein:

each of said feed bars includes a movable feed bar element and a stationary feed bar element; and said transfer system comprises:

four second casings, each of said second casings being fixedly mounted on a corresponding one of four corner portions of said bolster;

four first casings, each of said first casings being mounted on a respective one of said second casings so as to be vertically movable relative thereto;

lifting/lowering units provided with first motors and first threaded shafts operably connected with said first motors for driving each of said first casings so as to have the same lifted and lowered relative to each of said second casings, said first motors being fixedly mounted on each of said second casings;

clamping/unclamping units provided with second motors and second threaded shafts operably connected with said second motors for driving said stationary feed bar elements so as to perform the same clamping/unclamping operation on the workpiece, said second motors being fixedly mounted on each of said first casings; and, advancing/returning units provided with third motors and third threaded shafts operably connected with said third motors for driving the movable feed bar elements of said feed bars so as to perform the same advancing/returning operation on the workpiece, the movable feed bar element being moved relative to the stationary feed bar elements in said advancing/returning operation, said third motors being fixedly mounted on each of said first casings which are aligned in a given direction of said transfer system;

said bolster, with said feed bars and said transfer system mounted thereto, being together separable from the press by movement therefore;

said feed bars, said lifting winding units, said clamping/unclamping units, and said advancing/returning units being operable to perform the advancing/ returning, clamping/unclamping and lifting lowering operations while said bolster, with said feed bars and said transfers system mounted thereto, are separated from the press.

2. The transfer press as set forth in claim 1, wherein: each of said feed bars is of an integrated type in which said movable feed bar element and said stationary feed bar element are arranged in parallel with each other to minimize the entire longitudinal length of each of said feed bars.

3. In a transfer press having vertical support columns, including first columns and second columns, the first columns having a predetermined horizontal spacing from the second columns in a longitudinal direction, a bolster having four corners, and a pair of feed bars driven by a transfer system so as to perform advancing-/returning, clamping/unclamping and lifting/lowering operations on a workpiece so that the workpiece is sequentially transferred between dies disposed in successive work stations provided on the bolster, the improvement wherein:

each of said feed bars has a length measured in the longitudinal direction, the length being less than the predetermined spacing, each feed bar having opposite ends, both of the ends between the first columns and the second columns, each feed bar including a movable feed bar element and a stationary feed bar element, the movable feed bar being movable relative to the stationary feed bar in the longitudinal direction; and said transfer system includes four first casings;

four second casings respectively fixed to the four corners of said bolster, said first casings mounted respectively on each of said second casings so as to be vertically movable relative thereto, four lifting/lowering units, each having a first servo motor and a first threaded shaft operably connected with said first servo motor, for driving each of said four second casings so as to lift and lower said four first casings in a vertical direction relative to said four second casings, for performing the lifting/lowering operations on the workpiece, said four first servo motors fixed to the respective four second casings, four clamping/unclamping units, each having a second servo motor and a second threaded shaft operably connected with said second servo motor, for driving the stationary feed elements so as to move the stationary feed elements, and the movable feed elements therewith, toward and away from each other in a lateral direction transverse to the longitudinal and vertical directions, for performing the clamping/unclamping operations on the workpiece, the second servo motors of said four clamping/unclamping units fixed to the respective four first casings, and two advancing/returning units, each having a third servo motor and a third threaded shaft operably connected with said third servo motor, for driving said movable feed elements so as to move said movable feed elements relative to said stationary feed elements in the longitudinal direction, for performing the advancing/returning operations on the workpiece, the third servo motors of two advancing/returning units respectively fixed to two of the four first casings, said four clamping/unclamping units moving said two advancing/returning units with said two feed bars in the lateral direction, said bolster, with said two feed bars and said transfer system mounted thereto, being separable from the press by movement thereof in the lateral direction between the first columns and the second columns, said two feed bars, said lifting/lowering units, said four clamping/unclamping units, and said two advancing/returning units being operable to perform the advancing/returning, clamping/unclamping and lifting/lowering operations while said bolster, with said two feed bars and said transfer system mounted thereto, are separated from the press.

4. A transfer press according to claim 3, wherein said advancing/returning units each include a bearing, a ball-spline shaft rotatably mounted to said first casing through said bearing, a ball-spline nut member slidably engaged with said ball-spline shaft, a rotary element fixedly mounted on said ball-spline nut member, and a coupling, said third servo motor being connected with said ball-spline shaft through said coupling, said rotary member carried along said ball-spline shaft in the lateral direction with said stationary feed bar element.

5. A transfer press according to claim 4, wherein the first and second casings at each of the four corners of said bolster are vertically aligned.

6. A transfer press according to claim 3, wherein the first and second casings at each of the four corners of said bolster are vertically aligned.

* * * * *